US010400513B2

(12) United States Patent
Vatne

(10) Patent No.: US 10,400,513 B2
(45) Date of Patent: Sep. 3, 2019

(54) FLUID PRESSURE DRIVEN, HIGH FREQUENCY PERCUSSION HAMMER FOR DRILLING IN HARD FORMATIONS

(71) Applicant: Hammergy AS, Stavanger (NO)

(72) Inventor: Per A. Vatne, Kristiansand (NO)

(73) Assignee: Hammergy AS, Stavanger (NO)

( * ) Notice: Subject to any disclaimer, the term of this patent is extended or adjusted under 35 U.S.C. 154(b) by 732 days.

(21) Appl. No.: 14/766,479

(22) PCT Filed: Feb. 18, 2014

(86) PCT No.: PCT/NO2014/000019
§ 371 (c)(1),
(2) Date: Aug. 7, 2015

(87) PCT Pub. No.: WO2014/126476
PCT Pub. Date: Aug. 21, 2014

(65) Prior Publication Data

US 2015/0376949 A1 Dec. 31, 2015

(30) Foreign Application Priority Data

Feb. 18, 2013 (NO) ..... 20130271

(51) Int. Cl.
*E21B 4/14* (2006.01)
*E21B 1/00* (2006.01)

(52) U.S. Cl.
CPC ..... *E21B 4/14* (2013.01)

(58) Field of Classification Search
CPC ..... B25D 9/12; B25D 9/145; B25D 17/06; E21B 4/14

(Continued)

(56) References Cited

U.S. PATENT DOCUMENTS 1,096,886 A * 5/1914 Bayles ..... F01L 21/04 173/135
2,646,071 A * 7/1953 Wagner ..... F16K 15/023 137/528

(Continued)

FOREIGN PATENT DOCUMENTS

DE 3030910 A1 3/1981
EP 0171374 A1 2/1986

(Continued)

OTHER PUBLICATIONS

Bäcknert, Christer, "International Search Report," prepared for PCT/NO2014/000019, dated May 30, 2014, five pages.

*Primary Examiner* — Stephen F. Gerrity
*Assistant Examiner* — Joshua G Kotis
(74) *Attorney, Agent, or Firm* — Winstead PC

(57) ABSTRACT

A fluid pressure driven, high frequency percussion hammer for drilling in hard formations is presented. The hammer piston (20) of the percussion hammer has a relatively large and longitudinally extending bore (41) that provides minimal flow resistance for a drilling fluid flowing through the bore (41) during the return stroke of the hammer piston (20). The bore (41) is closeable in the upstream direction by a valve plug (23) that follows the hammer piston (20) during the stroke. The valve plug (23) is controlled by a relatively long and slender valve stem (49) that is mechanically able to stop the valve plug (23) by approximately 75% of the full stroke length of the hammer piston (20) and separates the plug (23) from a seat ring (40). Thus the bore (41) opens up such that the bore fluid can flow there trough, and the inherent tension spring properties of the valve stem (49) returns the valve plug (23) so rapid that it will be good through flow during return of the hammer piston (20). A magnet (58) retains the valve stem (49) in place.

11 Claims, 9 Drawing Sheets

(58) Field of Classification Search
USPC ..... 173/135, 136, 200; 175/296; 251/65; 137/909
See application file for complete search history.

(56) References Cited

U.S. PATENT DOCUMENTS 2,758,817 A 8/1956 Bassinger
3,130,799 A * 4/1964 Williams ..... E21B 6/00 175/92
3,327,790 A 6/1967 Vincent et al.
3,361,220 A * 1/1968 Brown ..... E21B 4/08 173/121
4,450,920 A 5/1984 Krasnoff et al.
4,462,471 A * 7/1984 Hipp ..... E21B 31/113 175/296
4,574,833 A * 3/1986 Custer ..... F16K 17/28 137/460
4,591,004 A * 5/1986 Gien ..... E21B 4/14 173/17
4,660,658 A 4/1987 Gustafsson
6,062,324 A * 5/2000 Hipp ..... E21B 4/14 175/296
7,681,658 B2 * 3/2010 Duval ..... B25D 9/04 173/1
2004/0140131 A1 * 7/2004 Susman ..... E21B 4/14 175/296
2005/0109521 A1 * 5/2005 Tornqvist ..... B25D 9/12 173/206

FOREIGN PATENT DOCUMENTS

EP 0209373 A2 * 1/1987 ..... B25D 9/16
GB 1275812 A 5/1972
NO 20111140 A 2/2013
SE 444127 B 3/1986
WO WO-2013028078 A1 2/2013

* cited by examiner

A 5 x ENLARGED 20 x ENLARGED 4 x ENLARGED

Pressure drop over the gradually closing valve

FLUID PRESSURE DRIVEN, HIGH FREQUENCY PERCUSSION HAMMER FOR DRILLING IN HARD FORMATIONS

TECHNICAL FIELD

The present invention relates to a fluid pressure driven, high frequency percussion hammer for drilling in hard formations, which percussion hammer comprises a housing, which in one end thereof is provided with a drill bit designed to act directly on the hard formation, which percussion hammer further comprises a hammer piston moveably received in said housing and acts on the drill bit, which hammer piston has a longitudinally extending bore having predetermined flow capacity, and the bore being closeable in the upstream direction by a valve plug that partly follows the hammer piston during its stroke until the plug is mechanically stopped, which valve plug is controlled by an associated valve stem slidably received in a valve stem sleeve, said valve stem comprises stopping means able to stop the valve plug and promptly returns the plug by a predetermined percentage of the full stroke length of the hammer piston and separates the valve plug from a seat seal on the hammer piston, such that said bore thus being opened and allows bore fluid to flow freely through the bore, such that the hammer piston can recoil by little resistance.

BACKGROUND

A percussion hammer of this nature is known from U.S. Pat. No. 4,450,920 and PCT/NO2012/050148. Further examples of prior art are shown in SE 444127B and U.S. Pat. No. 2,758,817A.

Hydraulically driven rig mounted percussion hammers for drilling in rock have been in commercial use for more than 30 years. These are used with joinable drill rods where the drilling depth is restricted by the fact that the percussion energy fades through the joints such that little energy finally reaches the drill bit.

Downhole hammer drills, i.e. hammer drills installed right above the drill bit, is much more effective and are used in large extent for drilling of wells down to 2-300 meter depth. These are driven by compressed air and have pressures up to approximately 22 bars, which then restricting the drilling depth to approximately 20 meters if water ingress into the well exists. High pressure water driven hammer drills have been commercial available more than 10 years now, but these are limited in dimension, as far as we know up to about 130 mm hole diameter. In addition, they are known to have limited percussion frequency, relatively low efficiency, and to have limited lifetime and are sensitive for impurities in the water. They are used in large extent in the mining industries since they are drilling very efficiently and drill very straight bores. They are used in a limited extent for vertical well drilling down to 1000-1500 meters depth, and then without any directional control.

It is desired to manufacture downhole drill fluid driven hammer drills which can be used together with directional control equipment, which have high efficiency, can be used with water as drill fluid and can also be used with water based drill fluid having additives, and having economical lifetime. It is expected great usage both for deepwater drilling for geothermic energy and for hard accessible oil and gas resources.

In percussion drilling, drill bits are used having inserted hard metal lugs, so called "indenters". These are made of tungsten carbide and are typically from 8 to 14 mm in diameter and have spherical or conical end. Ideally viewed, each indenter should strike with optimal percussion energy related to the hardness and the compressive strength of the rock, such that a small crater or pit is made in the rock. The drill bit is rotated such that next blow, ideally viewed, forms a new crater having connection to the previous one. The drilling diameter and the geometry determine the number of indenters.

Optimal percussion energy is determined by the compressive strength of the rock, it can be drilled in rock having compressive strength over 300 MPa. The supply of percussion energy beyond the optimal amount, is lost energy since it is not used to destroy the rock, only propagates as waves of energy. Too little percussion energy does not make craters at all. When percussion energy per indenter is known and the number of indenters is determined, then the optimal percussion energy for the drill bit is given. The pull, or drilling rate, (ROP—rate of penetration) can then be increased by just increasing the percussion frequency.

The amount of drilling fluid pumped is determined by minimum necessary return rate (annular velocity) within the annulus between the drill string and the well bore wall. This should at least be over 1 m/s, preferably 2 m/s, such that the drilled out material, the cuttings, will be transported to the surface. The harder and brittle the rock is, and the higher percussion frequency one is able to provide, the finer the cuttings become, and the slower return rate or speed can be accepted. Hard rock and high frequency will produce cuttings that appear as dust or fine sand.

The hydraulic effect applied to the hammer drill is determined by the pressure drop multiplied with pumped quantity per time unit.

The percussion energy per blow multiplied with the frequency provides the effect. If we look into an imaginary example where drilling into granite having 260 MPa compressive strength and drilling diameter of 190 mm is performed, water is pumped by 750 l/min (12.5 liters/second) from the surface. It is calculated that approximately 900 J is optimal percussion energy.

With reference to known data for corresponding drilling, but with smaller diameters, a drilling rate (ROP) of 22 m/h (meters per hour) with a percussion frequency of 60 Hz, can be expected. It is here assumed to increase the percussion frequency to 95 Hz, consequently ROP then become 35 m/h. Required net effect on the drill bit then becomes: 0.9 Kj×95=86 kW. We assume the present hammer construction to have a mechanical-hydraulic efficiency of 0.89, which then provides 7.7 MPa required pressure drop over the hammer.

This hammer drill will then drill 60% quicker and by 60% less energy consumption than known available water propelled hammer drills.

SUMMARY

This is achieved by a percussion hammer of the introductory said kind, which hammer is distinguished in that the stopping means include a magnet, which magnet cooperates with the valve stem in order to be able to retain the valve stem and thus the valve plug during predetermined conditions.

Thus it is to be understood that the stopping means of the valve stem has the ability to retain the valve plug at rest in the fully returned position until the seat seal of the hammer piston by return abuts this, the pressure builds up and the cycle is repeated. Due to the character of the valve mechanism including the ability to rapidly and precisely shift, stroke frequency is not limited by the valve mechanism. The stroke frequency is instead limited by the inherent recoil properties of the hammer piston. This provides the present percussion hammer high percussion frequency, little hydrodynamic loss and high efficiency.

Preferably the stopping means comprises a stop plate at the upstream end of the valve stem, and a cooperating internal stop surface in the valve stem sleeve.

In one embodiment the magnet can be located on an upstream located mounting plate.

In a second embodiment the magnet can constitute or be part of the stop plate on the valve stem, and the mounting plate itself be magnetic.

In one embodiment the predetermined percentage of the full stroke length of the hammer piston can be in the order of magnitude 75%.

It is the inherent tension spring properties of the valve stem that returns the valve plug, which valve stem being long and slender.

Preferably, the percussion hammer can further be provided with an inlet valve assembly, which does not open for operation of the hammer piston until the pressure is built up to approximately 95% of full working pressure, wherein the inlet valve assembly is adapted to close off a main barrel, and a side barrel within the hammer housing can pressurize an annulus between the hammer piston and the housing to elevate the hammer piston to seal against the valve plug.

The hammer piston and the valve assembly are returned by recoil, where both the hammer piston and the valve assembly are provided with hydraulic dampening controlling the retardation of the return stroke until stop.

In one embodiment the hydraulic dampening takes place with an annular piston which is forced into a corresponding annular cylinder with controllable clearances, and thus restricts or chokes the evacuation of the trapped fluid.

Further, an opening can be arranged in the top of the valve stem sleeve, into which opening the stop plate of the valve stem is able to enter, said radial portions of the stop plate seal against the internal side of the opening with relatively narrow radial clearance.

The percussion hammer housing can be divided into an inlet valve housing, a valve housing and a hammer housing.

The hammer drill construction according to the present invention is of the type labeled "Direct Acting Hammer", i.e. that the hammer piston has a closing valve thereon, which valve in closed position enables the pressure to propel the piston forward, and in open position enables the hammer piston to be subjected to recoil. The second variant of hydraulic driven hammers have valve controls that by forced control positions the hammer piston both ways. This provides poorer efficiency, but more precise control of the piston.

The key to good efficiency and high percussion frequency, is in the valve construction. The valve needs to operate with high frequency and have well through flow characteristics in open position.

With great advantage, the hammer drill construction can also be used as surface mounted hydraulically driven hammer for drilling with drill rods, but it is the use as a downhole hammer drill that will be described in detail here.

BRIEF DESCRIPTION OF THE DRAWINGS

Other and further objects, features and advantages will appear from the following description of preferred embodiments of the invention, which is given for the purpose of description, and given in context with the appended drawings where:

FIG. 4B shows an elevational view of the valve assembly shown in section in

FIG. 4A,

DETAILED DESCRIPTION

Figure 1:
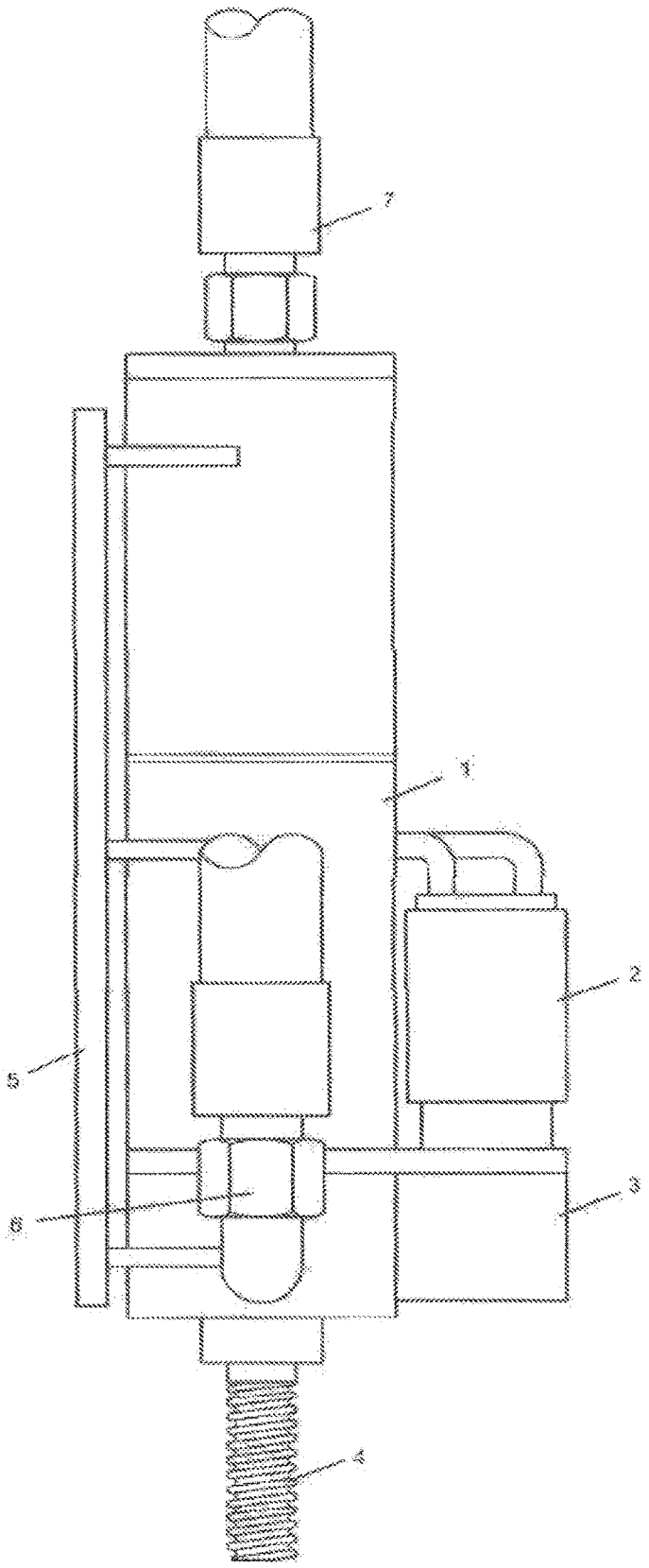
FIG. 1 shows in schematic view a typical hydraulic surface hammer drill for use with joinable drill strings.

FIG. 1 shows a typical hydraulic surface hammer drill for attachment on top of joinable drill rods where the hammer mechanism is located internal of a housing 1 constructed by several house sections, where a rotary motor 2 rotates a drill rod via a transmission 3 rotating an axle having a threaded portion 4 to be screwed to the drill rod and a drill bit (not shown). The hammer machine is normally equipped with a fixation plate 5 for attachment to a feeding apparatus on a drill rig (not shown). Supply of hydraulic drive fluid takes place via pipes and a coupling 6 and hydraulic return via pipes with a coupling 7. A complete function description of the hammer drill will follow on page 14.

Figure 2C:
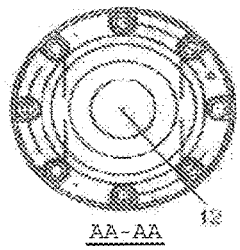
FIG. 2C shows a view in the direction of the arrows AA-AA in FIG. 2A.
Figure 2D:
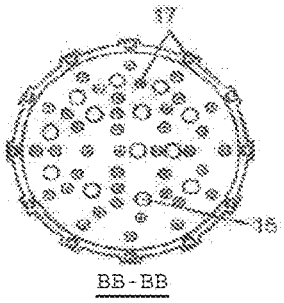
FIG. 2D shows a view in the direction of the arrows BB-BB in FIG. 2A.
Figure 2B:
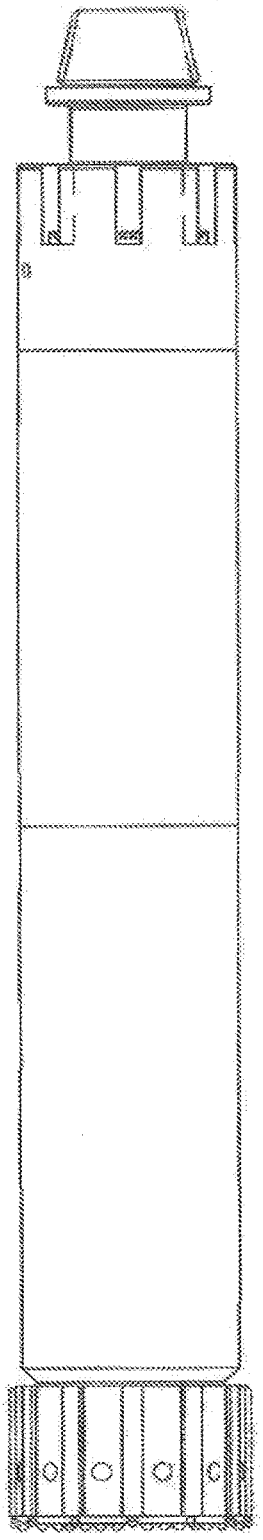
FIG. 2B shows the hammer drill of FIG. 2A turned about 90°.
Figure 2A:
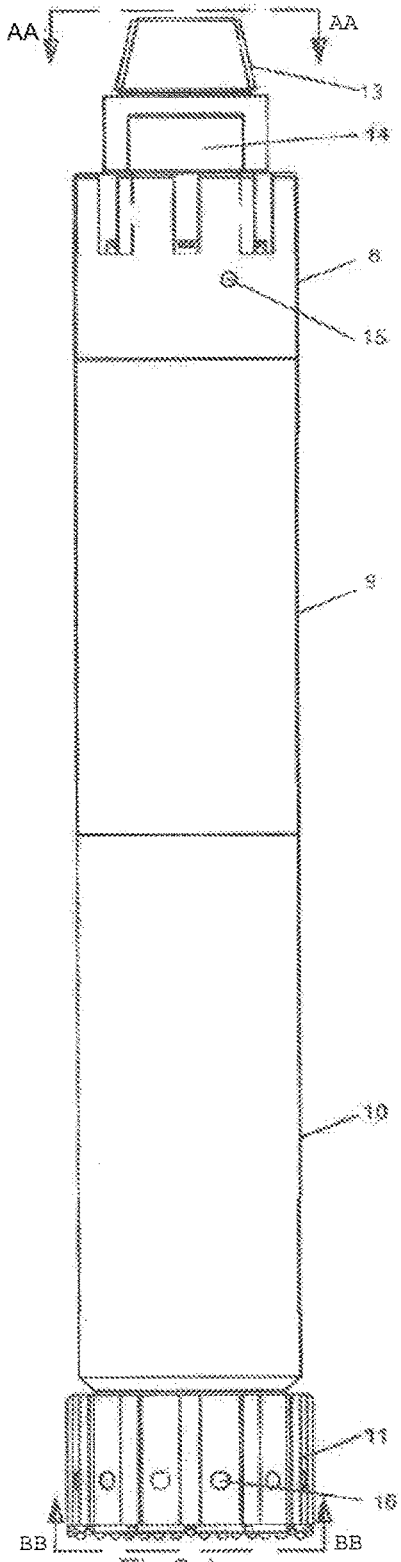
FIG. 2A shows an elevational view of a downhole hammer drill with drill bit.

FIGS. 2A and 2B show a downhole hammer drill with drill bit. These will be used in the following description. The illustrated housing 1 has a first house section 8 that receives what later on will be described as the inlet valve, while a second house section 9 contains a valve, a third house section 10 contains a hammer piston and the reference number 11 denotes the drill bit. Drill fluid is pumped in through an opening or main run 12, and a threaded portion 13 connects the hammer to the drill string (not shown). A flat portion 14 is provided for use of a torque wrench to screw the hammer to/from the drill string. A drain hole 15 is required for the function of the later on explained inlet valve, outlet hole 16 is present for return of the drill fluid in the annulus between the drill hole wall and the hammer drill housing (not shown) back to the surface. Hard metal lugs 17 are those elements that crush the rock being drilled. FIG. 2C shows a view in the direction of the arrows AA-AA in FIG. 2A, and FIG. 2D shows a view seen towards the drill bit 11 in the direction of the arrows BB-BB in FIG. 2A.

Figure 3F:
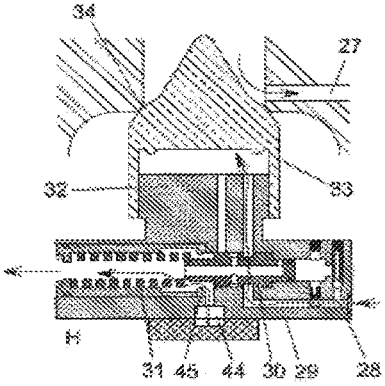
FIG. 3F shows a two times enlarged, encircled detail view H in FIG. 3A.
Figure 3G:
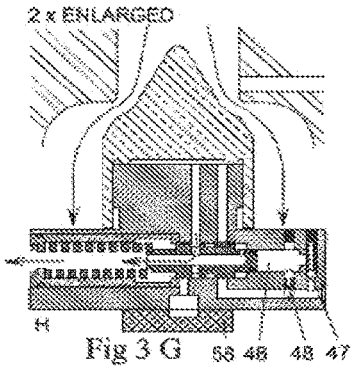
FIG. 3G shows a two times enlarged, encircled detail view H in FIG. 3A.
Figure 3H:
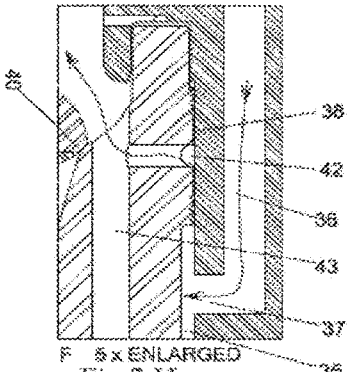
FIG. 3H shows a five times enlarged, encircled detail view F in FIG. 3A.
Figure 3I:
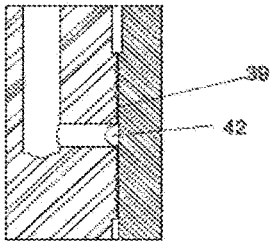
FIG. 3I shows a five times enlarged, encircled detail view G in FIG. 3A.
Figure 3B:
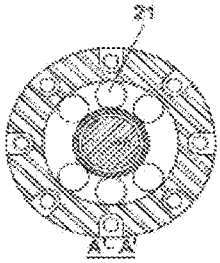
FIG. 3B shows a transversal cross sectional view along the line A'-A' in FIG. 3A.
Figure 3C:
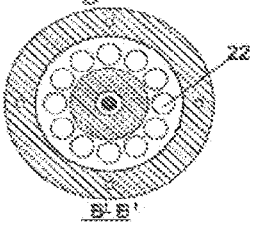
FIG. 3C shows a transversal cross sectional view along the line B'-B' in FIG. 3A.
Figure 3D:
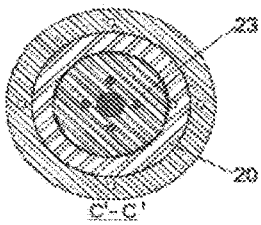
FIG. 3D shows a transversal cross sectional view along the line C'-C' in FIG. 3A.
Figure 3E:
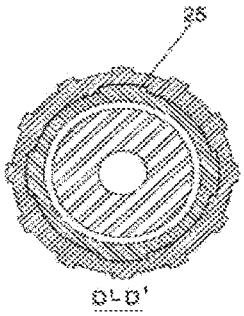
FIG. 3E shows a transversal cross sectional view along the line D'-D' in FIG. 3A.
Figure 3A:
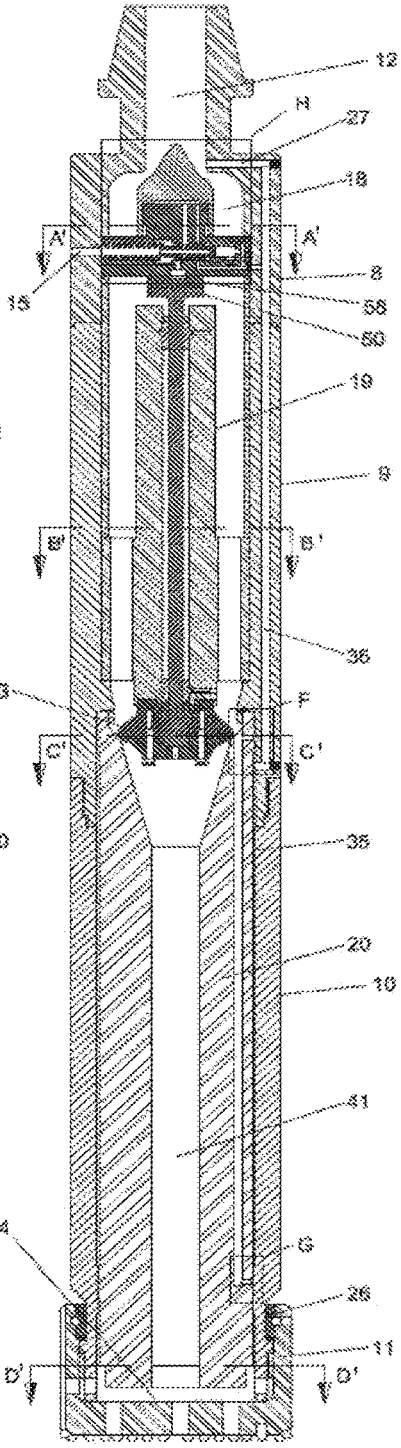
FIG. 3A shows a longitudinal sectional view of the hammer drill shown in FIG. 2A where the internal main parts are shown.

FIG. 3A shows a longitudinal section of the hammer drill where the internal main parts are: an inlet valve assembly 18, a valve assembly 19 and a hammer piston 20. An essential element in this construction is the magnet 58, which will be described in closer detail later on in connection with FIG. 6A. The drilling fluid is pumped in through the inlet 12, passes the inlet valve 18 in open position through bores 21 shown on section A'-A' in FIG. 3B, further through bores 22 in section B'-B' in FIG. 3C to a valve plug 23 that is shown in closed position in section C'-C' in FIG. 3D against the hammer piston 20 and drives the piston to abutment against the bottom portion 24 of the drill bit. Section D'-D' in FIG. 3E shows a longitudinally extending spline portion 25 in the drill bit 11 and the lowermost part of the hammer housing 10 that transfer the torque at the same time as the drill bit 11 can move axially within accepted clearances determined by a locking ring mechanism 26. This because by blows of the hammer piston 20 against the drill bit 11, it is only the mass or weight of this that is displaced in concert with penetration of the hard metal lugs 17 into the rock.

A starting procedure by means of the inlet valve 18 will now be described. The detailed section in FIG. 3F showing the inlet valve 18 in closed position is taken from H in FIG. 3A. When the hammer function is to be initiated, the pumping operation of the drill fluid in the inlet 12 is commenced. A side, or branch off, bore 27 through the wall of the valve house 8 has hydraulic communication with a pilot bore 28 in the mounting plate 29 of the inlet valve 18. The mounting plate 29 is stationary in the valve house 8 and contains a pilot valve 30 that is retained in open position by a spring 31. The drill fluid flows freely to a first pilot chamber above a first pilot piston 32, the diameter and area of which are larger than the area of the inlet 12. During pressure buildup, a limited moveable valve plug 33 will be forced to closure against a valve seat 34 in the housing 8. Under pressure buildup against closed inlet valve 18, an annulus 35 between the housing 10 and the hammer piston 20 is pressurized through the side bore 27, which via longitudinally extending bores 36 in the valve housing 9 feed an inlet 37, see detailed view F. The magnet 58 is also shown on FIGS. 3F and 3G, but the magnet has no effect on the start itself.

The detailed sections in FIG. 3H and FIG. 3I are taken from F and G in FIG. 3A and show the abutment of the hammer piston 20 against the inner wall of the hammer housings 9, 10. The diameter of a piston 38 is somewhat larger than the diameter of a second piston 39. By the use of the hammer drill to drill vertically downwards, the hammer piston 20 will in unpressurized condition, due to the gravity, obviously creep towards the strike or impact surface 24 in the drill bit 11. In this condition there will be clearance between the valve plug 23 and its seat 40 (see detailed view F) in the hammer piston 20. Accordingly the drill fluid will flow freely through the valve at the plug 23, through a bore 41 in the hammer piston 20 and the bores 16 (see FIG. 2A), and therefore too little pressure buildup takes place to start the hammer.

The arrangement shown in detailed section in FIG. 3F, having closed inlet valve 18 and pressure buildup in the annulus 35, elevates the hammer piston 20 to seal against the valve plug 23. Due to the required clearance between the surface of the piston 38 and the inner wall of the housing 9, drilling fluid leaks out in the space above the valve plug 23 through lubrication channels 42 and a bore 43 such as an arrow shows in detailed view F. In order to prevent that this leakage volume shall provide pressure buildup in the space above the valve plug 23, this is drained through a bore 44 in the valve mounting plate 29 and an opening 45 that the pilot valve 30 in this position allows, and further out through the drain hole 15. When the pressure has increased to over 90% of the working pressure the hammer is designed for, the piston force in a second pilot chamber 46 exceeds the closing force of the spring 31 and the pilot valve 30 shifts position such as illustrated in FIG. 3G.

The first pilot chamber above the pilot piston 32 is drained and the inlet valve 18 opens up. At the same time the opening 45 is closed such that drainage through the bore 44 is shut off so that pressure is not lost through this bore in operating mode. The pressure in the chamber above the hammer piston 20 and the closed valve plug 23 results in start of the working cycle with instant full effect. The arrangement with a backup valve 47 and a nozzle 48 is provided to obtain a reduced drainage time of the second pilot chamber 46 for thereby achieve relatively slow closure of the inlet valve 18. This to obtain that the inlet valve 18 remains fully open and is not to make disturbances during a working mode since the pressure then fluctuates with the percussion frequency.

Figure 4D:
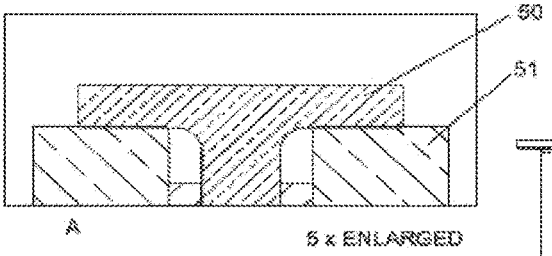
FIG. 4D shows a five times enlarged, encircled detail view A in FIG. 4A.
Figure 4B:
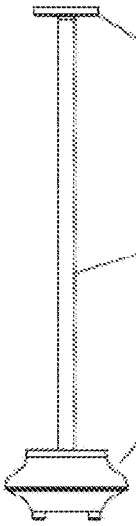
Figure 4C:
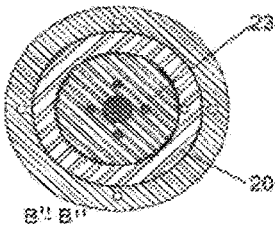
FIG. 4C shows a transversal cross sectional view along the line B"-B" in FIG. 4A.
Figure 4E:
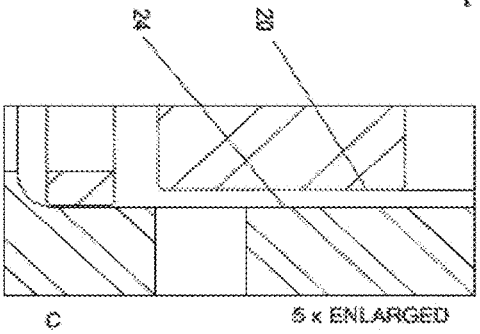
FIG. 4E shows a five times enlarged, encircled detail view C in FIG. 4A.
Figure 4A:
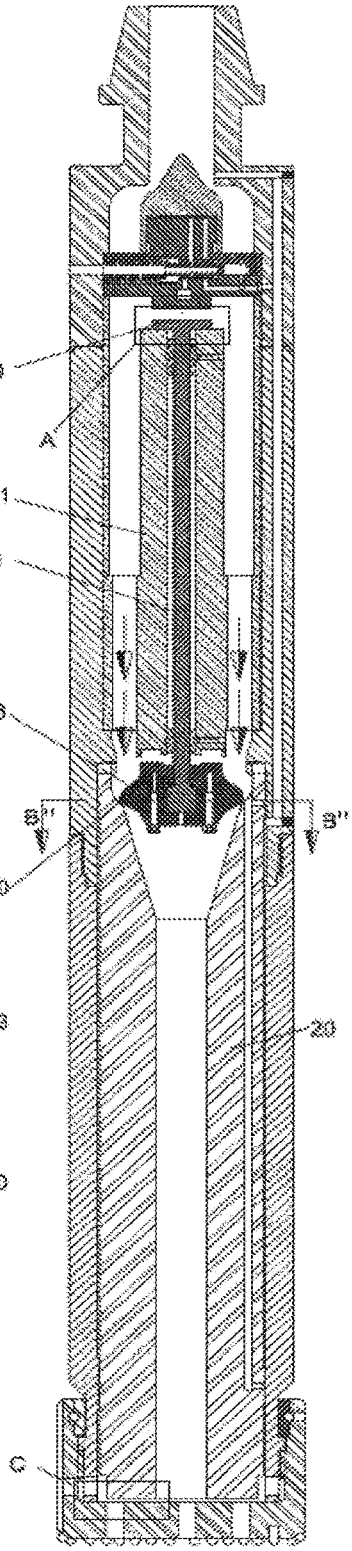
FIG. 4A shows correspondingly to that shown in FIG. 3A, but at the end of an acceleration phase.

FIG. 4A shows the hammer drill at the end of an accelerating phase. The hammer piston 20 has at this moment arrived at max velocity, typically about 6 m/s. This is a result of available pressure, as an example here just below 8 MPa, the hydraulic area of the hammer piston, here for example with a diameter of 130 mm, and the weight of the hammer piston, here for example 49 kg. The valve plug 23 is kept closed against the seat opening of the hammer piston since the hydraulic area of the valve plug 23, here for example with a diameter of 95 mm, is a bit larger, about 4%, than the annular area of the hammer piston shown in section B"-B" in FIG. 4C as 23 and 24 respectively. At this moment the hammer piston has covered about 75% of its full stroke, about 9 mm. The clearance between the hammer piston 20 and the strike surface 24 of the drill bit is about 3 mm, shown in enlarged detailed view C in FIG. 4E.

A moveable valve stem 49 having a stop plate 50 now lands on the abutment surface of a stationary valve stem sleeve 51 in the housing 9 and stops by pure mechanical abrupt stop the valve stem 49 and thus the valve plug 23, from further motion, as shown in enlarged detailed view A in FIG. 4D, after which the valve plug 23 is separated from the seat 40 in the hammer piston 20 and thereby being opened. The moveable valve assembly 23, 49, 50 is shown in elevational view in FIG. 4B.

The kinetic energy of the valve plugs 23 momentum will by the abrupt stop thereof, marginally elongate the relatively long and slender valve stem 49, and thereby transform to a relatively large spring force that very quickly accelerates the valve in return (recoil). The marginal elongation of the valve stem 49, here as an example calculated to be about 0.8 mm, needs to be lower than the utilization rate of the material, which material in this case is high tensile spring steel. The mass of the valve plug 23 should be as small as possible, here as an example made of aluminum, combined with the length, the diameter and the properties of the material of the valve stem 49, determines the natural frequency of the valve assembly.

For practical usages, this should be minimum 8-10 times the frequency it is to be used for. The natural frequency is determined by the formulas:

$$fn = \frac{1}{2\pi}\sqrt{\frac{k}{M}}$$

$$\text{where } k = \frac{F}{\sigma}$$

The mass and the spring constant have most significance. The natural frequency for the shown construction is about 1100-1200 Hz and therefore usable for a working frequency over 100 Hz.

The shown construction has in this example a recoil velocity that is 93% of the impact or strike velocity.

Figure 5B:
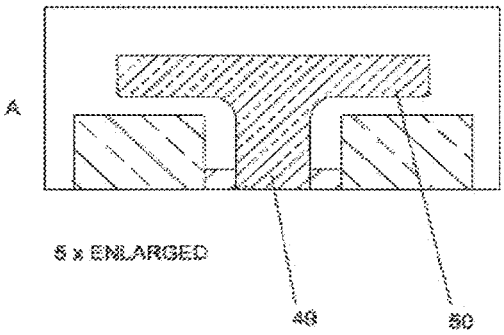
FIG. 5B shows a five times enlarged, encircled detail view A in FIG. 5A.
Figure 5C:
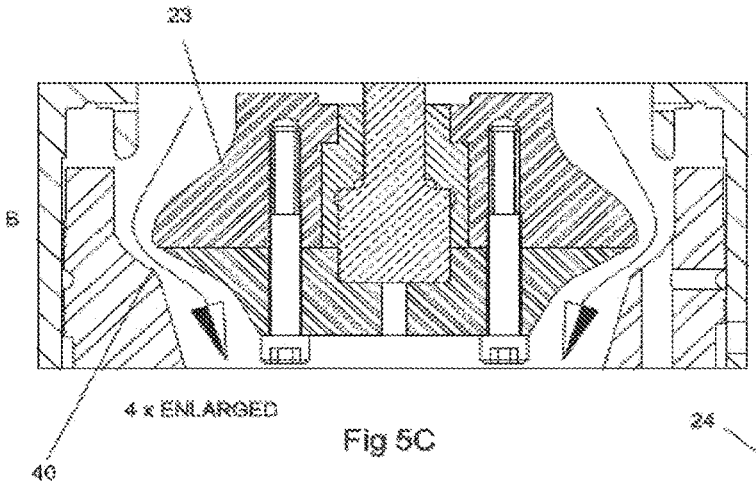
FIG. 5C shows a four times enlarged, encircled detail view B in FIG. 5A.
Figure 5A:
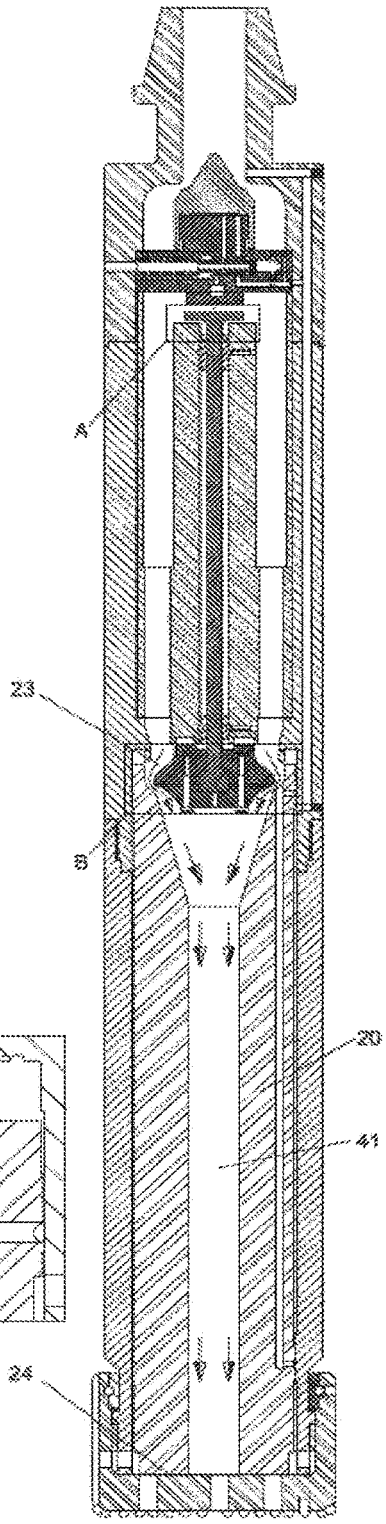
FIG. 5A shows correspondingly to that shown in FIGS. 3A and 4A, but in that moment when the hammer piston strikes against the impact surface in the drill bit.

FIG. 5A shows the position and the moment for when the hammer piston 20 strikes against the strike or abutment surface 24 within the drill bit 11. The valve plug 23 including the stem 49 and the stop plate 50 are in full return speed, see detailed view A in FIG. 5B, such that relatively fast a large opening between the valve plug 23 and the valve seat 40 on the hammer piston 20 is created, such that drilling fluid now flows by relatively small resistance through the longitudinal bore 41 in the hammer piston 20, see detailed view B in FIG. 5C.

The kinetic energy of the hammer pistons 20 momentum is partly transformed into a spring force in the hammer piston 20, since the piston is somewhat compressed during the impact. When the energy wave from the impact has migrated through the hammer piston 20 to the opposite end and back, the hammer piston 20 accelerates in return. The return velocity here at the start is calculated to be about 3.2 m/s, about 53% of the strike or impact velocity, this because a portion of the energy has been used for mass displacement of the drill bit 11, while the rest has been used to depress the indenters into the rock.

Figure 6B:
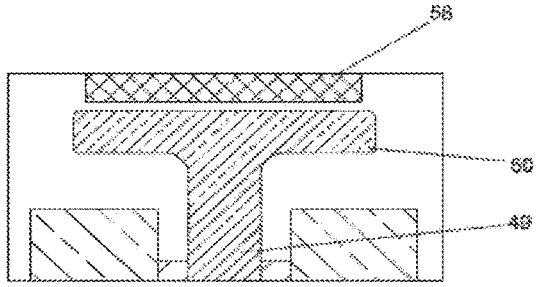
FIG. 6B shows a five times enlarged, encircled detail view A in FIG. 6A.
Figure 6C:
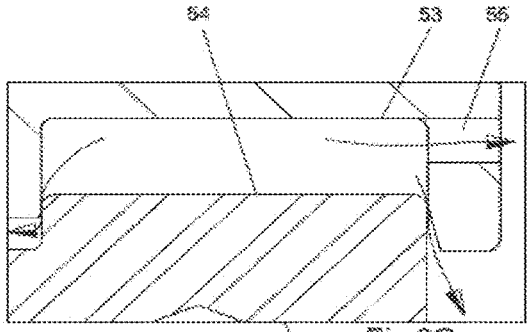
FIG. 6C shows a 20 times enlarged, encircled detail view C in FIG. 6D.
Figure 6D:
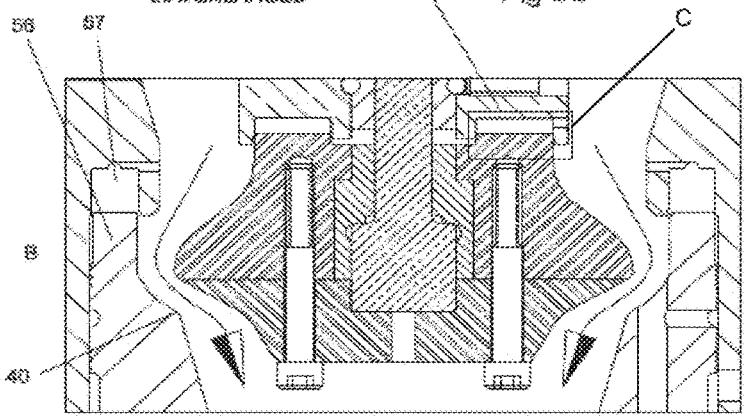
FIG. 6D shows a four times enlarged, encircled detail view B in FIG. 6A.
Figure 6A:
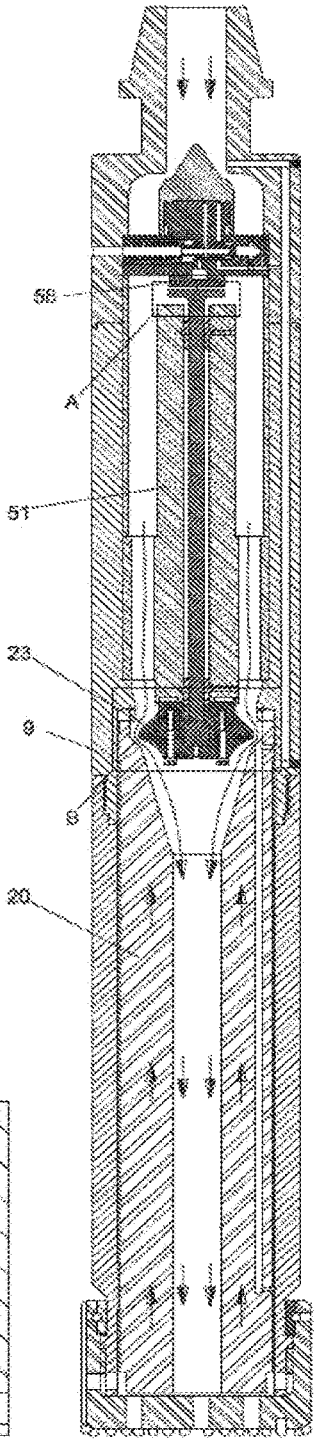
FIG. 6A shows correspondingly to that shown in FIGS. 3A, 4A and 5A, but when the hammer piston is in full return.

FIG. 6A shows that moment when the hammer piston 20 is in its full return speed. The valve plug 23 has at this point of time almost returned to the end stop where the detailed view A in FIG. 6B shows the stem 49 including the stop plate 50 that abuts the top of the valve stem sleeve 51.

The detailed view A in FIG. 6A shows how the stop plate 50 in the illustrated embodiment is substantially planar and faces toward a magnet 58 which is arranged on the mounting plate 29. That magnet surface facing towards the top surface is also substantially planar. The magnetic action between the magnet 58 and the stop plate 50 prevents that the valve plug 23 performs recoil motion and remains in position until next cycle begins. It is also a possible variant that the magnet 58 constitutes the stop plate 50 on the valve stem 49 or that it is a part of the stop plate 50, and that the mounting plate 29 itself is made of a magnetic material having the ability to attract the stop plate 50 and thus the valve plug 23.

The detailed view B in FIG. 6A illustrated in FIG. 6D shows the relatively large opening between the valve plug 23 and the valve seat 40 in the hammer piston 20, in order that the flow of drilling fluid there through takes place with a minimum of resistance. The underside of the valve stem sleeve 51 is formed as an annular cylinder pit 53 shown in detailed view C in FIG. 6C (illustrated in FIG. 6D) in order to provide a dampening action when the stop plate 50 approaches the magnet 58 during the recoil motion of the valve assembly 23, 49, 50. The top of the valve plug 23 is formed as an annular piston 54, which by relatively narrow clearances fits into the annular cylinder pit 53. The confined fluid volume is, as the valve returns all the way to the end stop, evacuated in a controlled way through the radial clearances between the annular piston 54 and the annular cylinder 53 plus an evacuation hole 55. This controlled evacuation acts as a dampening force and stops the return of the valve in such a way that the valve does not perform recoil motions. The same type of dampening arrangement is present on the hammer piston 20. On the detailed view B in FIG. 6D is an annular piston 56 shown on top of the hammer piston 20, in addition to an annular cylinder groove 57 in the lower part of the valve housing 9.

Figure 7B:
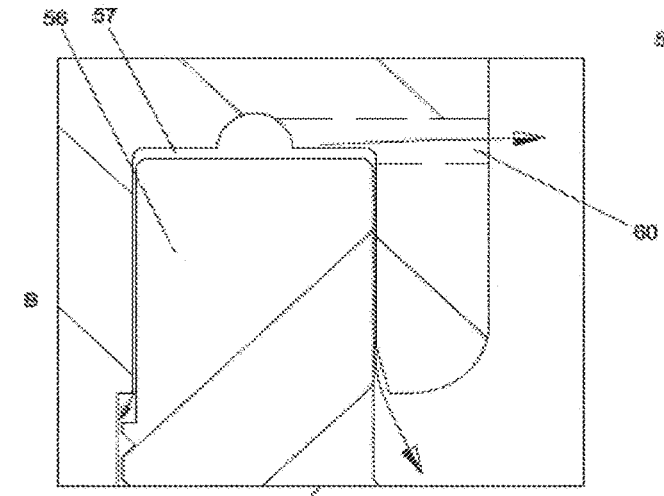
FIG. 7B shows a 20 times enlarged, encircled detail view B in FIG. 7C.
Figure 7C:
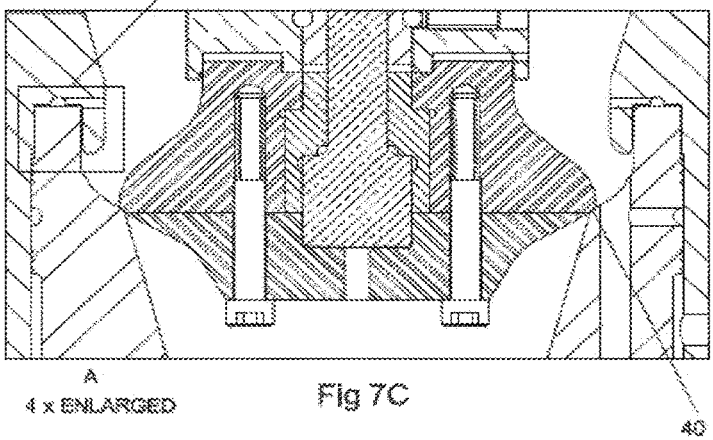
FIG. 7C shows a four times enlarged, encircled detail view A in FIG. 7A.
Figure 7A:
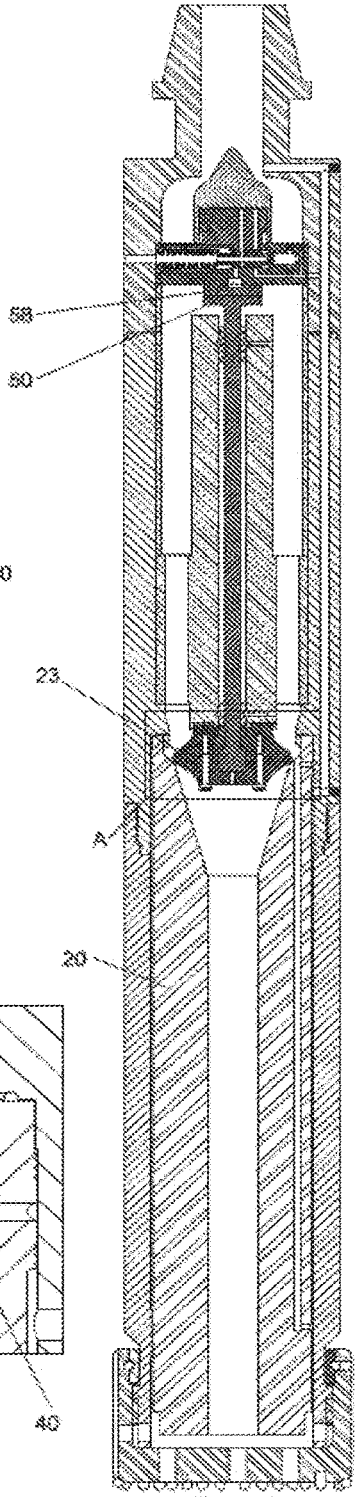
FIG. 7A shows correspondingly to that shown in FIGS. 3A, 4A, 5A and 6A, but when the hammer piston is in the final part of the return.

FIG. 7A shows the last part of the return of the hammer piston 20. The termination of the return stroke is dampened in a controlled way until full stop at the same time as the valve seat 40 meets the valve plug 23, shown in detailed view A in FIG. 7C. The detailed view B in FIG. 7B illustrates how the confined or trapped fluid volume within the annular cylinder pit 57 is displaced through the radial clearances between the annular piston 56 and a drain hole 60.

The gap between the valve seat 40 and the valve plug 23 do not need to be completely closed for the pressure to build up and start a new cycle. Calculations show that with an opening of 0.5 mm, the pressure drop is approximately the same as the working pressure. This results in that the surface pressure on the contact surface between the valve plug 23 and the seat 40 becomes small and the components can experience long life time.

Figure 8:
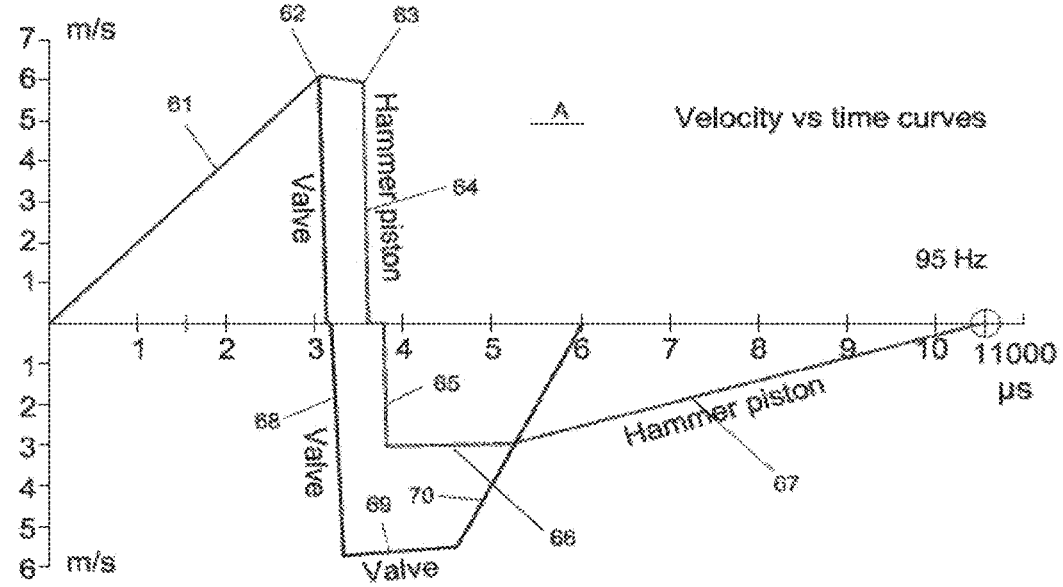
FIG. 8 shows curves that illustrates the working cycle of the hammer piston and the valve.
Figure 8:
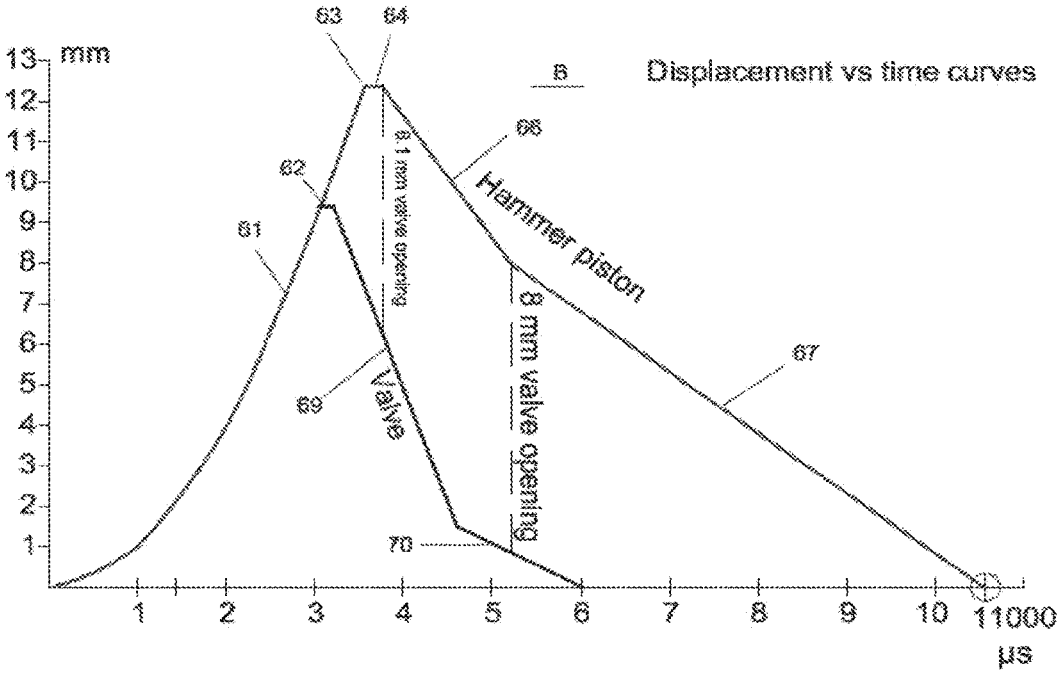

FIG. 8 shows curves that illustrate the working cycle of the hammer piston 20 and the valve. Curve A shows the velocity course and curve B the position course through a working cycle. For both curves the horizontal axis is the time axis, divided into micro seconds.

The vertical axis for curve A shows the velocity in m/s, stroke direction against the drill bit 11 as + upwards, and − downwards, here the return velocity.

The vertical axis for the curve B shows distance in mm from the start position. The curve section 61 shows the acceleration phase, where the point 62 is the moment when the valve is stopped and the return thereof is initiated. The point 63 is the impact of the hammer piston 20 against the drill bit 11.

The curve section 64 is the displacement of the drill bit 11 by progress into the rock, 65 is the acceleration of the recoil, 66 is the return velocity without dampening and 67 is the return velocity with dampening. The curve section 68 is the recoil acceleration for the valve, 69 is the return velocity for the valve without dampening and 70 is the slowdown dampening phase for the return of the valve.

The now introduced magnet 58 is essential for safe retaining of the valve assembly 23, 49, 50 in the starting position until the hammer piston 20 is returned. The valve assembly needs to be kept at rest in this period of time. On the lower curve B in FIG. 8 this is shown from about 6 to 11 on the time axis (6000 to 11000 milliseconds).

Figure 9B:
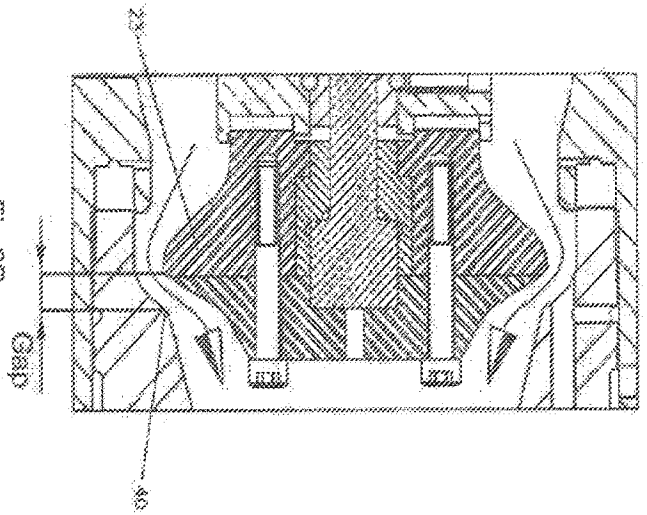
FIG. 9B illustrates flow and pressure drop over the gradually closing valve.
Figure 9A:
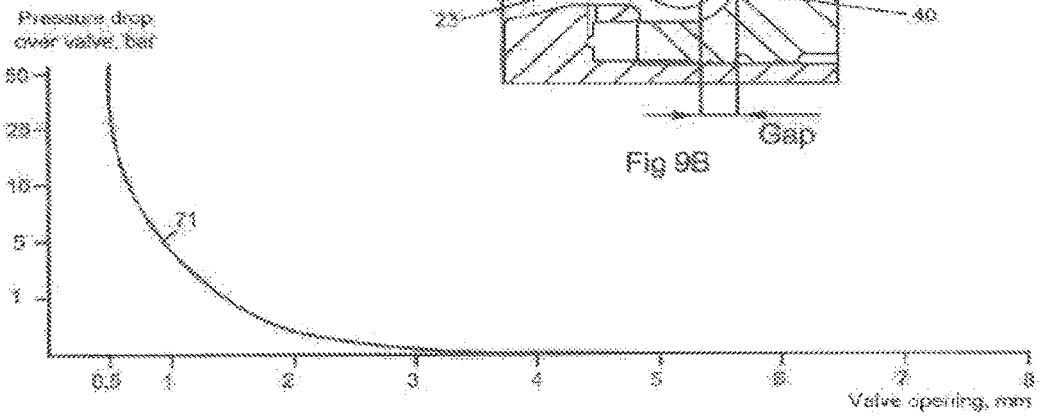
FIG. 9A shows the curve that illustrates the abrupt closing characteristic of the valve relative to pressure drop.

FIG. 9A shows a curve 71 that illustrates the abrupt closing characteristics for the valve with regard to the pressure drop and opening between the valve plug 23 and the seat 40 in the hammer piston. This situation is shown in FIG. 9B. The horizontal axis is the opening gap in mm and the vertical axis the designed pressure drop in bar at nominal rate of pumped drilling fluid, which, as an example here, is 12.5 l/sec. As shown, the closing gap needs to get under 1.5 mm before a substantial pressure resistance is received.

The way of operation of the percussion hammer will now be described. The specific dimensions given are not to be limiting, but just to be considered as examples to ease the understanding of the concept. During start up, the valve 18 is in function, as previously mentioned, and seals for the opening 12 in that the valve plug 23 seats against the seat 34, see FIG. 3F. When the percussion hammer has started, the valve 18 is no longer in function and remains open as shown in FIG. 3G.

The first phase is shown in FIG. 3A. The hammer piston 20 is at maximum distance from the bottom 24 of the drill bit 11, and is indicated to be in order of magnitude 12 mm. At the same time the valve plug 23 is suspended in the magnet 58 via the valve stem 49 and the stop plate 50. In addition, the valve plug 23 bears against the seat 40 which is internally provided in the top of the hammer piston 20 as shown on FIG. 4A. When the valve plug 23 is sealing against the seat 40, the supplied hydraulic fluid through the channel 12 will act against the valve plug 23 and the annular top surface of the hammer piston 20, see FIG. 3D, which together constitute the hydraulic area acting with a downwards directed force. Thus the motion downwards is initiated as also illustrated with reference number 61 in FIG. 8. FIG. 4A shows that such a downwardly directed motion is ongoing and the hammer piston 20 approaches the bottom 24 within the drill bit 11, here indicated that about 3 mm remains. As illustrated, the stop plate 50 has been released from the magnet 58 and is in turn stopped against the top of the valve stem sleeve 51. This means that since the hammer piston 20 has still a little distance to travel, about 3 mm, until it reaches the bottom 24, the valve plug 23 is lifted off the seat 40 and provides opening for the hydraulic fluid.

At this moment, due to the moment of inertia of the valve plug 23, combined with the long and slender valve stem 49, the plug 23 will continue further about 0.8 mm before the valve plug 23 returns with recoil action due to the elongation in the long and slender valve stem 49. The hammer piston 20 continues downwards until, with force, hits against the bottom surface 24 in the drill bit 11 as shown in FIG. 5A, i.e. the hammer stroke itself against the rock. The recoil action brings the valve plug 23 upwards again and provides larger opening at the valve seat 40. As shown in FIG. 6A, the valve plug 23, the valve stem 49 and the stop plate 50 move further upward and subsequently so far that the stop plate 50 has returned to the magnet 58, as shown on FIG. 7A. In order to avoid impact between the stop plate 50 and the magnet 58, in addition to vibrations, the recoil motion is dampened when the valve plug 23 approaches the lower end of the valve stem sleeve 51, see FIGS. 6D and 6C.

Something similar takes place with the hammer piston 20. As shown on FIG. 6A, a recoil action in the hammer piston 20 has moved the piston 20 in return upwards as illustrated in that there is distance between the bottom 24 in the drill bit and the hammer piston 20. FIG. 7A shows the hammer piston 20 completely returned to the position of origin and a new cycle can begin.

It is to be understood that the mechanical energy build up in the impact is used to the return, i.e. a recoil energy. The recoil energy can be defined as:

k multiplied with x where k=spring constant and x=length.

k is dependent of the proportions of the object, slenderness and length.

x is the compressed length for the hammer piston and the elongated length for the valve stem.

The response time is independent of length. A long piston will recoil slower than a short one, but recoil a shorter distance. The recoil is coming when the energy vibrations or oscillations have propagated through the object from impact to opposite end and returned back, i.e. the velocity of sound of the material multiplied with the length multiplied with 2. This means 2L divided on 5172 m/s. For the piston this will be about 200 micro seconds and for the valve a little more than the half thereof. That is why the valve stem 49 here is shown shorter that the hammer piston 20, meaning faster response.

It is further to be understood that x is independent of the force being built up, the momentum of mass and the abrupt stop. The diameter and length of the valve stem 49 is determined by that the stem is to be elongated sufficiently to provide surplus of return energy, and at the same time the material shall not be overstressed. In practice, about half the yield limit is utilized, since the life time then will be long.

Fine polishing of the surface of the valve stem will probably be necessary in avoiding the appearance of fissures or rupture nicks. The surface can for example be treated by so called shot peening, i.e. ball bombed or glass blasted. Such is used on highly fatigue exposed parts in the weapon and airplane industries.

The invention claimed is:

1. A fluid pressure driven high frequency percussion hammer for drilling in hard formations comprising:

a housing which in one end thereof is provided with a drill bit designed to act directly on the hard formation;

a hammer piston moveably received in said housing and adapted to act on the drill bit;

a valve plug;

a valve stem slidably received in a valve stem sleeve and comprising a stopping element;

wherein the hammer piston comprises a longitudinally extending bore having a predetermined flow capacity, the longitudinally extending bore being closeable in an upstream direction by the valve plug that follows the hammer piston during a portion of a downstroke until the valve plug is mechanically stopped by the stopping element;

wherein the valve plug is controlled by the valve stem, said stopping element configured to stop the valve plug at a predetermined percentage of a full stroke length of the hammer piston and separate the valve plug from a seat seal on the hammer piston such that said longitudinally extending bore is opened and bore fluid is allowed to flow freely through the longitudinally extending bore such that the hammer piston can recoil;

wherein when the valve plug is separated from the seat seal, the valve stem is adapted to be elongated by kinetic energy of the valve plug, wherein the elongation of the valve stem generates a spring force that returns the valve stem and valve plug to a fully returned position; and wherein the stopping element comprises a magnet that is configured to retain the valve stem and the valve plug at rest in the fully returned position.

2. The percussion hammer according to claim 1, wherein the stopping element comprises a stop plate arranged on an upper end of the valve stem and a cooperating internal stop surface in the valve stem sleeve.

3. The percussion hammer according to claim 2, wherein a mounting plate is arranged above the valve stem in the housing.

4. The percussion hammer according to claim 3, wherein the magnet constitutes or is part of said stop plate on the valve stem, and the mounting plate is magnetic.

5. The percussion hammer according to claim 1, wherein the predetermined percentage of the full stroke length of the hammer piston is approximately 75%.

6. The percussion hammer according to claim 1, wherein:

inherent tension spring properties of the valve stem returns the valve plug; and said valve stem comprises a diameter and length such that the valve stem is to be elongated to provide return energy without yielding.

7. The percussion hammer according to claim 1, wherein:

the percussion hammer is further provided with an inlet valve assembly which does not open for operation of the hammer piston until the pressure is built up to approximately 95% of full working pressure;

said inlet valve assembly being adapted to close off a main channel; and a side bore within the housing pressurizes an annulus between the hammer piston and the housing to elevate the hammer piston to seal against the valve plug.

8. The percussion hammer according to claim 7, wherein the hammer piston and the valve assembly return by recoil, where both the hammer piston and the valve assembly are provided with hydraulic dampening controlling retardation of a return stroke until stop.

9. The percussion hammer according to claim 8, wherein the hydraulic dampening takes place by an annular piston which is forced into a corresponding annular cylinder having controllable clearances thereby restricting evacuation of trapped fluid.

10. The percussion hammer according to claim 1, wherein an opening is arranged in a top surface of the valve stem sleeve, into which opening the stopping element of the valve stem is able to enter, radial portions of the stopping element seal against an internal side of the opening.

11. The percussion hammer according to claim 1, wherein the housing is divided into an inlet valve housing, a valve housing, and a hammer housing.

* * * * *